US005525066A

United States Patent [19]

Morlion et al.

[11] Patent Number: 5,525,066

[45] Date of Patent: Jun. 11, 1996

[54] CONNECTOR FOR A CABLE FOR HIGH FREQUENCY SIGNALS

[75] Inventors: Danny Morlion, St. Amandsberg; Luc Jonckheere, Louvain; Jan P. K. van Koetsem, Zwijnrecht, all of Belgium

[73] Assignee: Framatome Connectors International, Paris, France

[21] Appl. No.: 399,171

[22] Filed: Mar. 2, 1995

[30] Foreign Application Priority Data

Mar. 3, 1994 [NL] Netherlands ..... 9400321

[51] Int. Cl.[6] ..... H01R 4/66

[52] U.S. Cl. ..... 439/108; 439/608; 439/701

[58] Field of Search ..... 439/607, 608, 439/609, 610, 101, 108, 701

[56] References Cited

U.S. PATENT DOCUMENTS

| | | | |
|---|---|---|---|
| 4,867,707 | 9/1989 | Widdoes | 439/675 |
| 5,066,236 | 11/1991 | Brocksteeg | 439/608 X |
| 5,088,932 | 2/1992 | Nakamura | 439/350 |
| 5,310,354 | 5/1994 | Oswald, Jr. | 439/608 X |
| 5,330,371 | 7/1994 | Andrews | 439/608 X |

FOREIGN PATENT DOCUMENTS

| | | |
|---|---|---|
| 0455367 | 11/1991 | European Pat. Off. . |
| 0560551 | 9/1993 | European Pat. Off. . |
| WO93/12564 | 6/1993 | WIPO . |

*Primary Examiner* Khiem Nguyen
*Attorney, Agent, or Firm* Perman & Green

[57] ABSTRACT

A connector for a cable for high frequency signals, in particular for connecting cables with contact pins on a printed circuit board comprises a ground plate, a housing of dielectric material with cavities for receiving female contact members, at least one female signal contact member and at least one female ground contact member. The (each) ground contact member is formed out of the ground plate unitary with the ground plate.

7 Claims, 7 Drawing Sheets

CONNECTOR FOR A CABLE FOR HIGH FREQUENCY SIGNALS

BACKGROUND OF THE INVENTION

The invention relates to a connector for a cable for high frequency signals, in particular for connecting cables with contact pins on a printed circuit board, comprising a ground plate, a housing of dielectric material with cavities for receiving female contact members, at least one female signal contact member and at least one female ground contact member.

Such a connector is disclosed for example in EP-A-0 620 616. This known connector shows the advantage that the female ground contact is substantially made in the same manner as the female signal contact members. The female ground contact member is however made as a separate component, wherein a connection with the ground plate is obtained by a contact spring member formed at the ground contact member.

The invention aims to provide an improved connector of the above-mentioned type.

SUMMARY OF THE INVENTION

To this end the connector according to the invention is characterized in that the (each) ground contact member is formed out of the ground plate unitary with the ground plate.

In this manner a connector is obtained which on the one hand can be manufactured in a simple manner and wherein on the other hand an optimum connection is guaranteed between the (each) ground contact member and the ground plate. The dimensions of the connector can be chosen in a suitable manner such that all female contact members are located in a grid pattern of points with a spacing of 2 mm.

In an application of the connector for twinaxial cables it is advantageous according to the invention if a central part of the ground plate is bent into a U-shaped part, wherein contact springs are formed in the opposite legs of the U-shaped part, said contact springs being adapted to engage a ground contact pin insertable into the U-shaped part. Thereby a connector for two twinaxial cables is obtained, wherein both pairs of signal contact members are separated from each other by a ground contact member.

According to another embodiment of the connector according to the invention at least one end edge of the ground plate is bent into a U-shaped end part, wherein contact springs are formed in the opposite legs of the U-shaped edge part, said contact springs being adapted to engage a ground contact pin insertable into the U-shaped edge part. Such a connector can be made for a single coaxial or twinaxial cable. As an alternative it is also possible to provide each end edge with an integrated ground contact for a connector for two twinaxial cables.

In the latter case it is also possible according to the invention that the ground plate comprises edge parts substantially perpendicular to the main surface of the ground plate, wherein a ground contact spring is formed out of each edge part, said ground contact spring projecting into an adjacent cavity of the housing and adapted to engage a ground contact pin insertable into said cavity.

In an embodiment of the connector according to the invention with ground contact members at the end edges whereby seven contact members are aligned, relatively much space is occupied on the printed circuit board. According to the invention it is sufficient to have five contact members aligned if a plurality of housings with ground plate and female contact members are mounted in a second housing of insulating material, wherein each ground plate comprises at both sides a lateral extension with an edge part substantially perpendicular to the main surface of the ground plate, said edge part being located on an outer wall of the second housing and adapted to cooperate with a contact spring of a shielding plate of a connector with male contact pins.

BRIEF DESCRIPTION OF THE DRAWINGS

The invention will be further explained hereinafter by reference to the drawings in which some embodiments of the connector of the invention are shown.

DETAILED DESCRIPTION OF THE PREFERRED EMBODIMENTS

Figure 1:
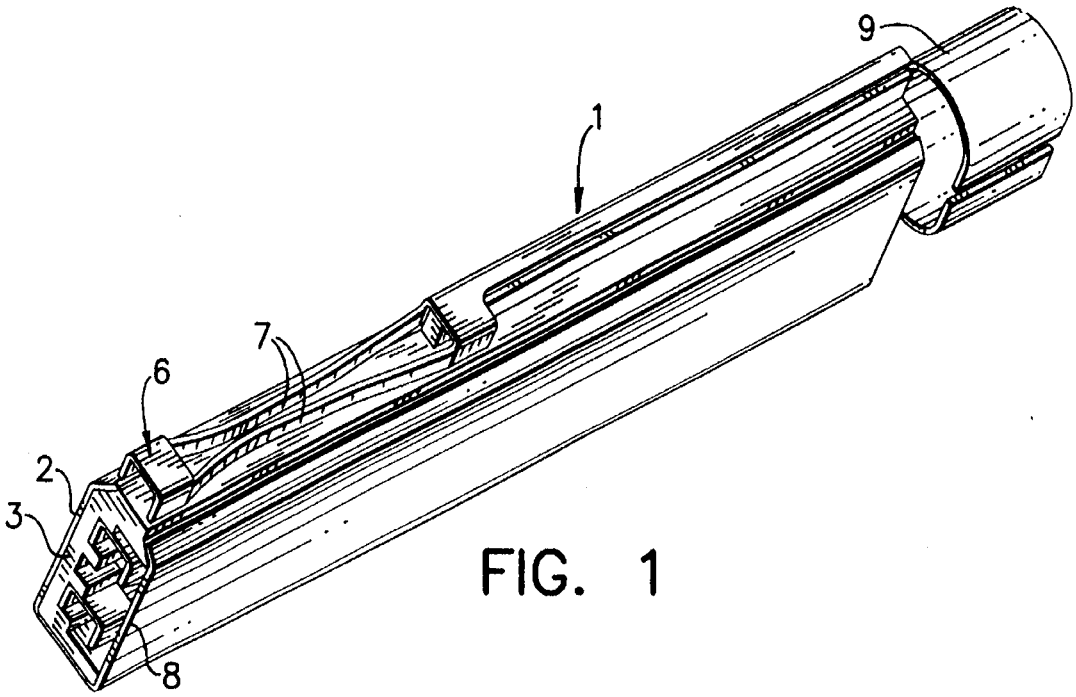
FIG. 1 shows a perspective view of a contact assembly of a first embodiment of the connector of the invention for a twinaxial cable.
Figure 2:
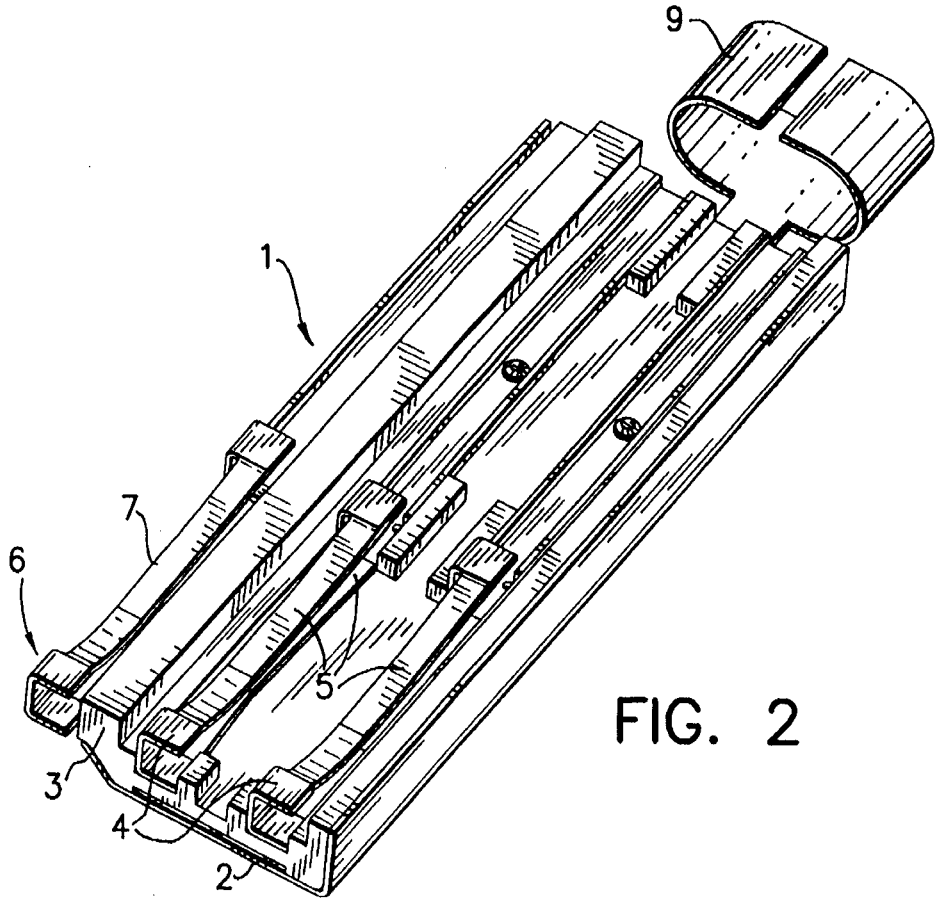
FIG. 2 is a cutaway perspective view of the contact assembly of FIG. 1.

FIGS. 1 and 2 show a contact assembly 1 for a connector adapted to connect a twinaxial cable with the contact pins of a printed circuit board not shown. The contact assembly 1 is provided with a ground plate 2, a housing 3 of dielectric material being mounted in said ground plate. Cavities for receiving female signal contact members 4 are formed in the housing 3. These female signal contact members 4 each comprise two contact springs 5 adapted to engage a contact pin which can be inserted into the female signal contact member.

An end edge of the ground plate 2 is bent into a U-shaped edge part 6 wherein contact springs 7 are formed in the opposite legs of the U-shaped edge part 6, so that the U-shaped edge part 6 forms a ground contact member corresponding with the female signale contact members 4. The contact springs 7 are adapted to engage a ground contact pin which can be inserted into the U-shaped edge part 6. The ground contact member formed by the U-shaped edge part 6 is formed out of the ground plate 2 itself by means of usual machining techniques and is thereby automatically unitary with the ground plate.

A part 8 of the ground plate 2 not shown in FIG. 2 is bent over the open upper side of the housing 3, so that the signal contact members 4 are fully surrounded by the ground plate 2. At the end opposite of the contact members the ground plate 2 is provided with a clamping ring 9 which can be clamped on the shielding of the cable after connecting the twinaxial cable to the contact assembly 1. If the cable is provided with a separate drain wire this drain wire can be soldered to the clamping ring 9.

It is noted that the contact assembly 1 described together with one or more corresponding contact assemblies can be mounted in a common second housing so that a plurality of contact assemblies form together one connector for a plurality of twinaxial and/or coaxial cables.

Figure 3:
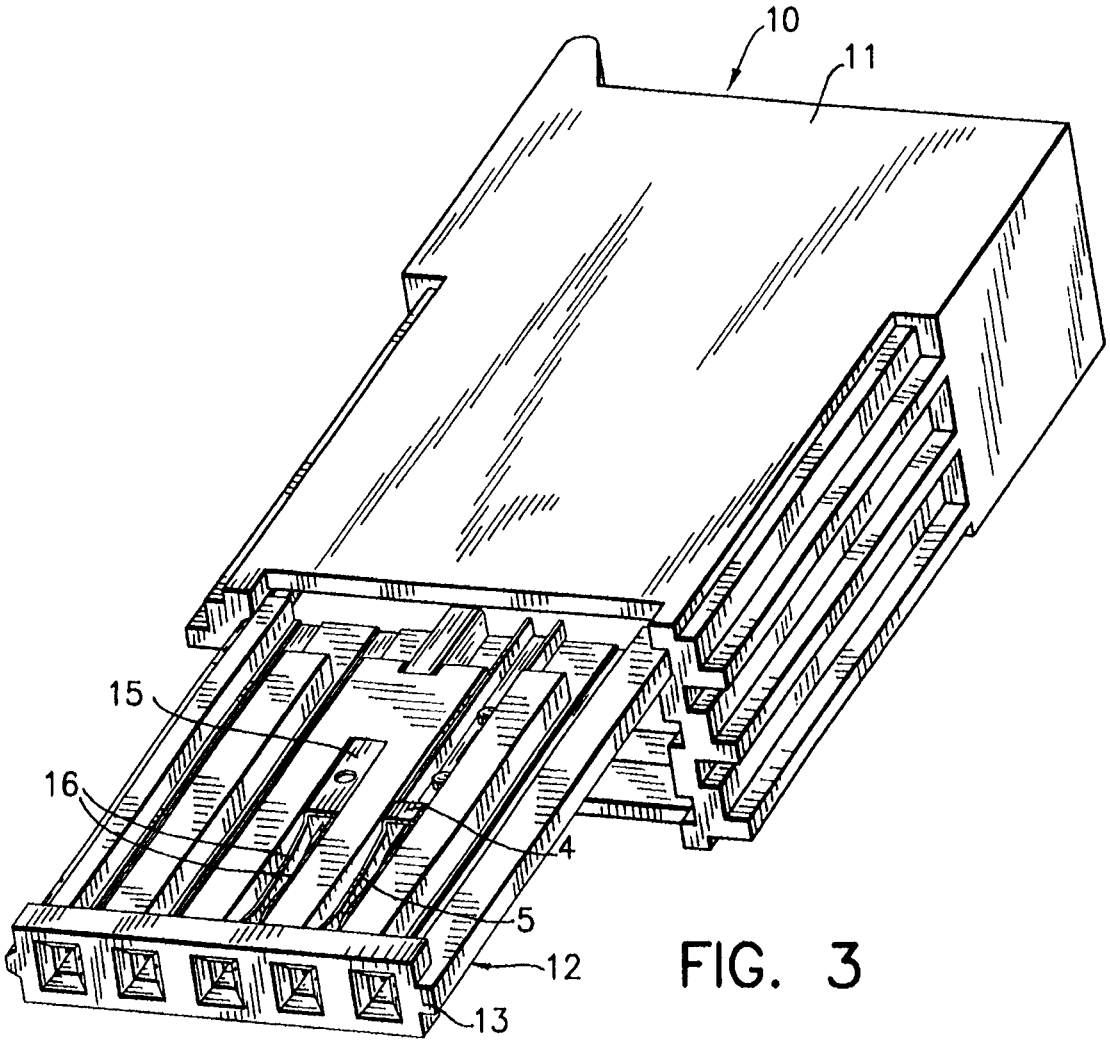
FIG. 3 shows a second embodiment of the connector of the invention for six twinaxial cables.

In FIG. 3 there is shown a connector 10 with a housing 11 in which three connector modules 12 can be mounted, one of which is shown in FIG. 3. The modular construction of the connector is further described in EP-A-94203166.

Figure 4:
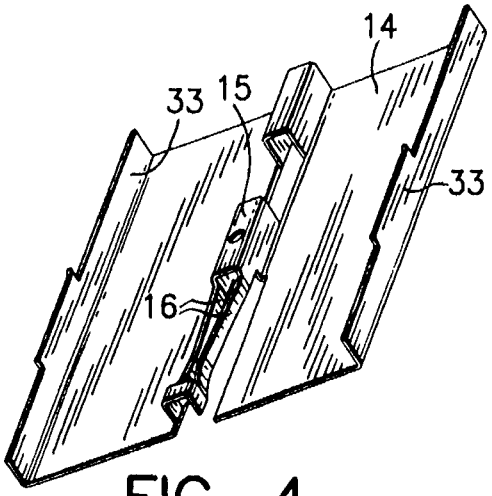
FIG. 4 shows a perspective view of a ground plate of the connector shown in FIG. 3.
Figure 8:
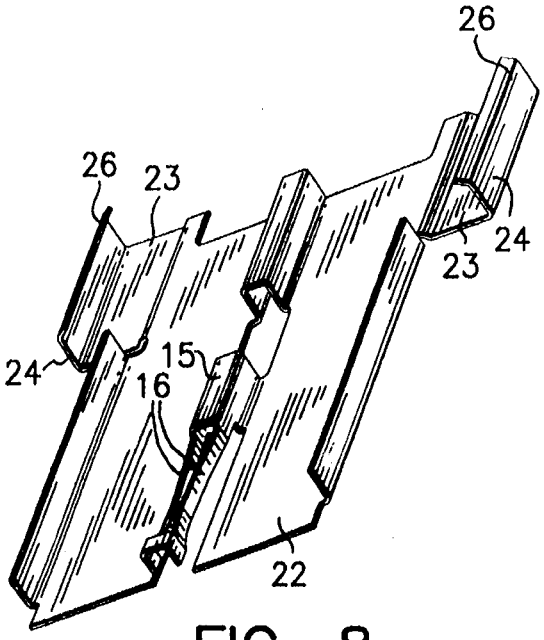
FIG. 8 shows a perspective view of a second ground contact plate of the connector of FIGS. 5 and 6.

Each connector module 12 comprises a housing 13 consisting of dielectric material and having four cavities for female signal contact members 4 with contact springs 5. Only one signal contact member 4 is shown in FIG. 3. Further the housing 13 comprises a ground plate 14 shown in a perspective view in FIG. 4, said ground plate 14 having a central part bent into a U-shaped part 15 which is also received in a cavity of the housing 13 as shown in FIG. 3. Contact springs 16 are formed in the opposite legs of the U-shaped part 15, said contact springs 16 being adapted to engage a ground contact pin which can be inserted into the U-shaped part 15. The U-shaped part 15 forms a ground contact member corresponding with the female signal contact members 4.

Therefore the two pairs of signal contact members 4 of the connector module 12 are separated by a ground contact member 15 formed out of the ground plate 14. In the embodiment shown in FIG. 3 the signal contact members 4 are not surrounded by the ground plate 14 on one side. For both connector modules not shown lying below the connector module 12, the ground plate 14 of the next connector module acts also a ground plate part providing a complete enclosure of the signal contact members 4. For the connector module 12 shown in FIG. 3 a last ground plate part not shown can be mounted.

Figure 7:
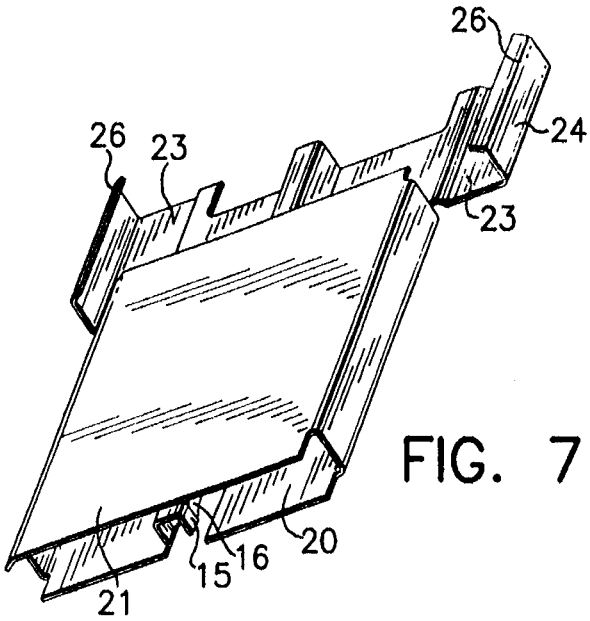
FIG. 7 shows a perspective view of a first ground contact plate of the connector of FIGS. 5 and 6.
Figure 5:
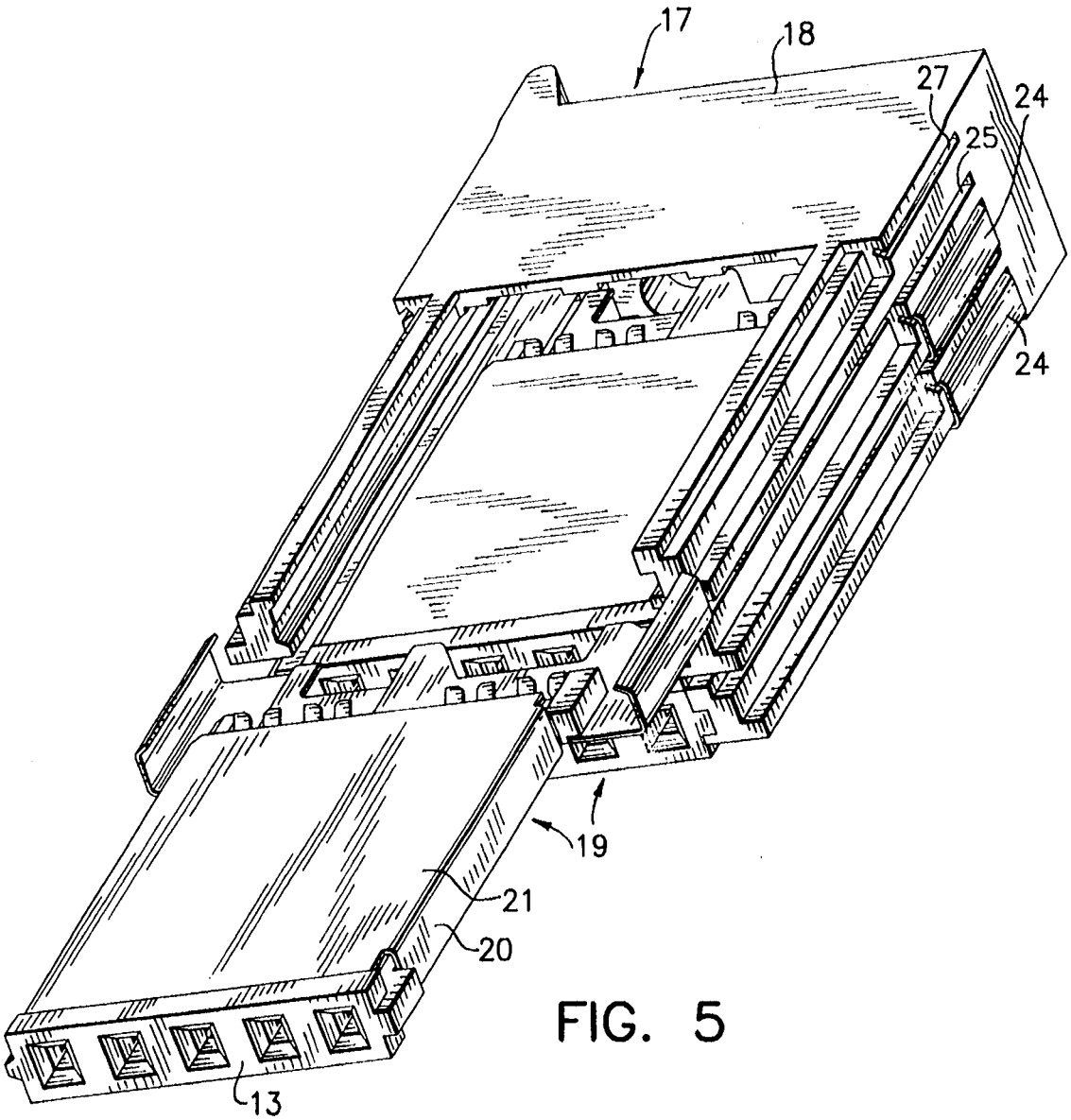
FIG. 5 shows a perspective view of a third embodiment of the connector of the invention in a partially disassembled manner.
Figure 6:
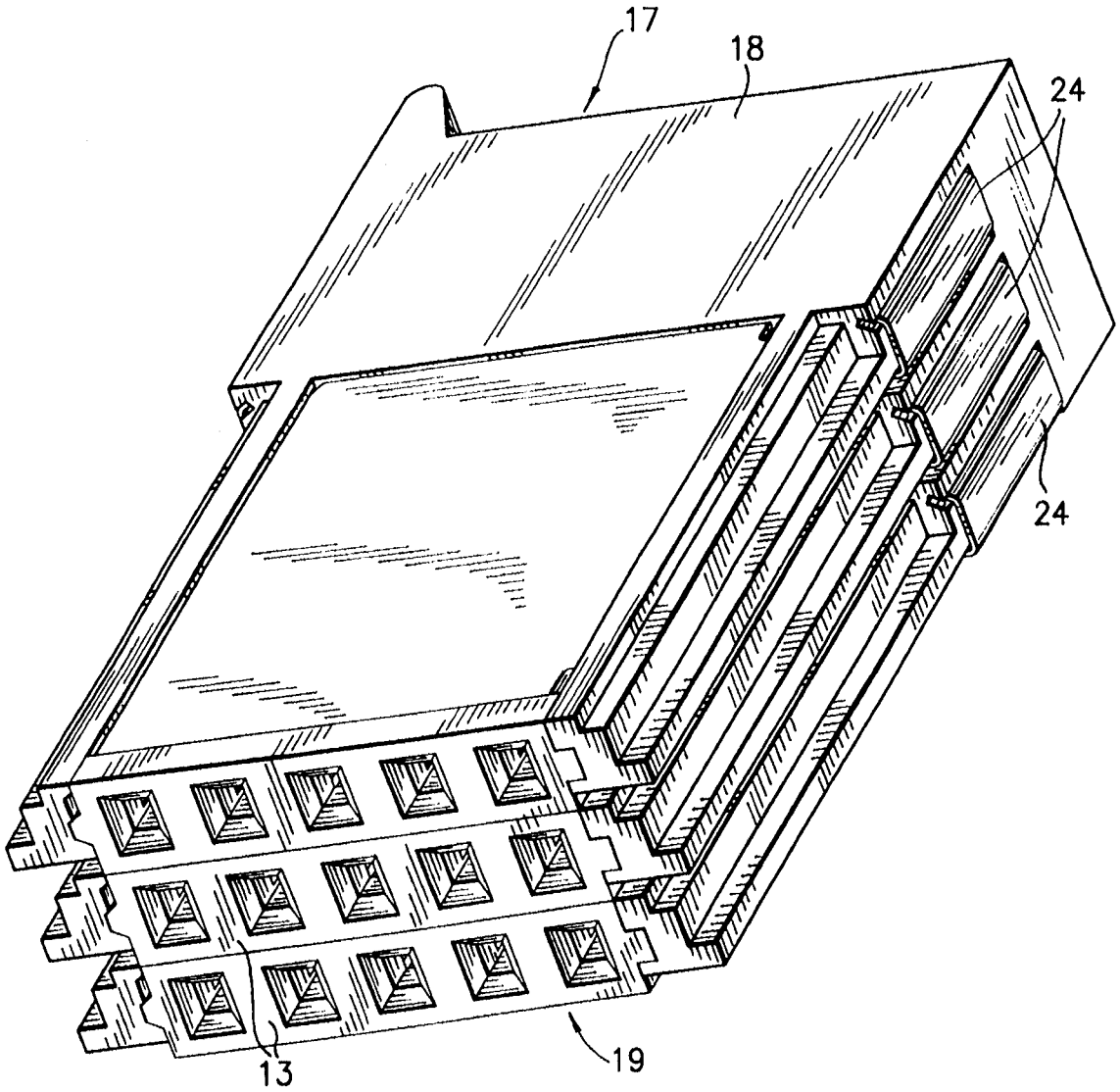
FIG. 6 shows the connector of FIG. 5 fully assembled.

In order to improve the EMI performance of the connector it is preferred to provide ground contact members at both sides of the signal contact members 4. In FIGS. 5 and 6 a connector 17 is shown with a housing 18 with three connector modules 19 mainly made in the same manner as the connector module 12. In FIG. 5 the connector module 19 lying at one end of the housing 18 is not yet pushed into the housing 18. This connector module 19 is provided with a housing 13 and a ground contact plate 20 shown in a perspective view in FIG. 7. As shown in FIG. 7, the ground contact plate 20 is provided with a central U-shaped part 15 and a plate part 21, so that the signal contact members 4 are fully surrounded by the ground plate 20. Both further connector modules 19 are provided with a housing 13 and a ground plate 22 which lacks the plate part 21 as compared with ground plate 20. For these connector modules 19 the ground plate 20 of the next connector module acts as further ground plate.

As appears from FIGS. 5–8, each ground plate 20, 22 is provided at both sides with a lateral extension 23 with an edge part 24 substantially perpendicular to the main surface of the ground plate. FIGS. 5 and 6 show that this edge part 24 can be shoven into the housing 18 through a slot 25 and will be lying on the outer wall 26 of the housing 18. Each edge part 24 has an end edge 26 which is bent obliquely inwardly and is received in a slot 27 of the housing 18, so that the edge part 24 cannot be bent away from the outer wall of the housing 18.

Figure 9:
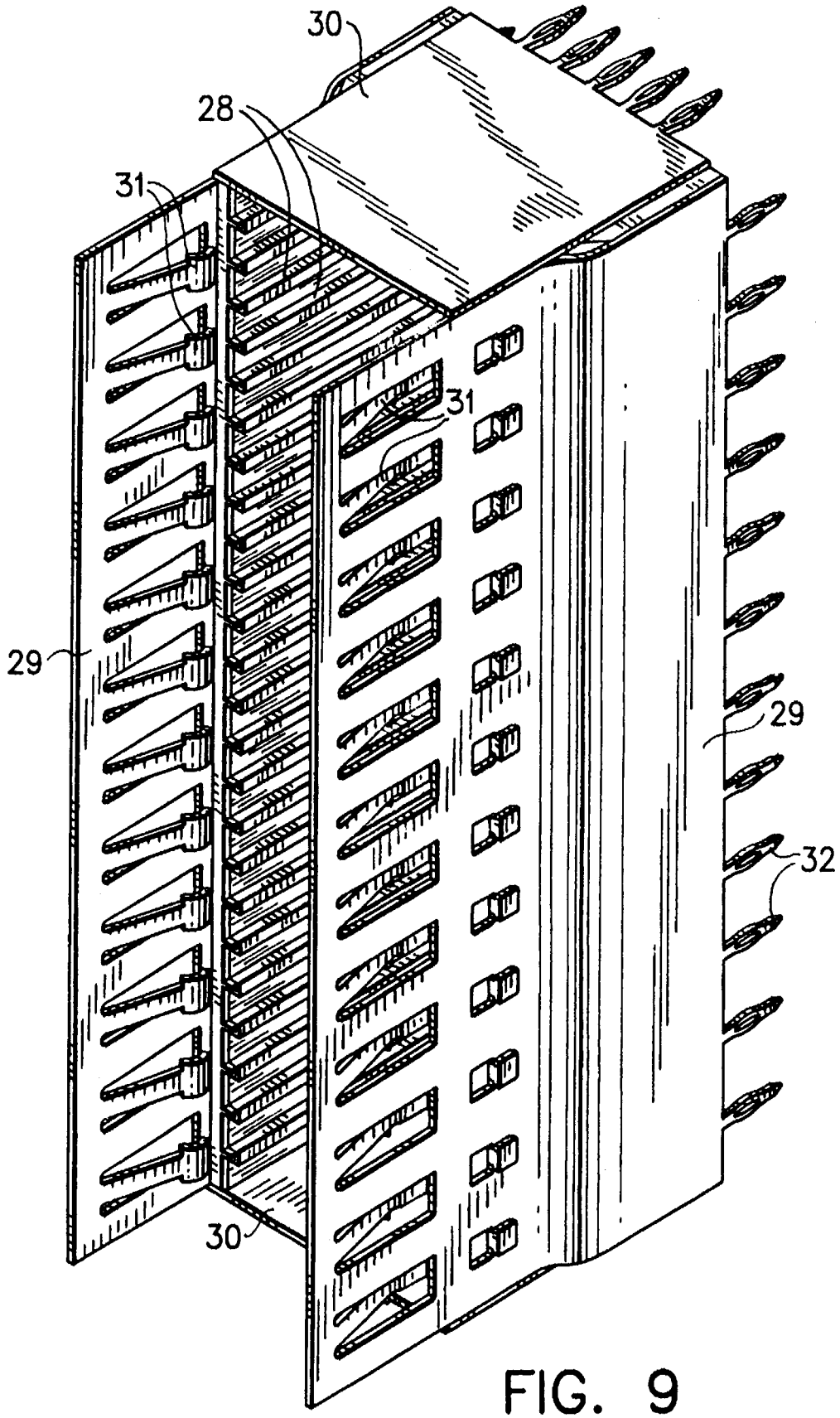
FIG. 9 shows a perspective view of a housing with shielding plates to be mounted on contact pins of a printed circuit board not further shown, said housing being adapted to cooperate with the connector of FIGS. 5 and 6.

FIG. 9 shows a housing 28 with shielding plates 29 and 30, the shielding plates 29 having contact springs 31. The shielding plates 29, 30 are further provided with press-fit pin parts 32 which can be inserted into the holes of a printed circuit board. The housing 28 is provided in a usual manner with a bottom having openings for receiving contact pins (not shown) which are previously inserted into the printed circuit board. The connector 17 can be pushed on the contact pins wherein the edge parts 24 cooperate with the contact springs 31. The housing 28 is adapted to receive four connectors 17.

The embodiment described shows the advantage that for providing ground connections at the outer sides of each connector module 19 no further contact pins are required, so that in the width direction only five contact pins are aligned.

Figure 10:
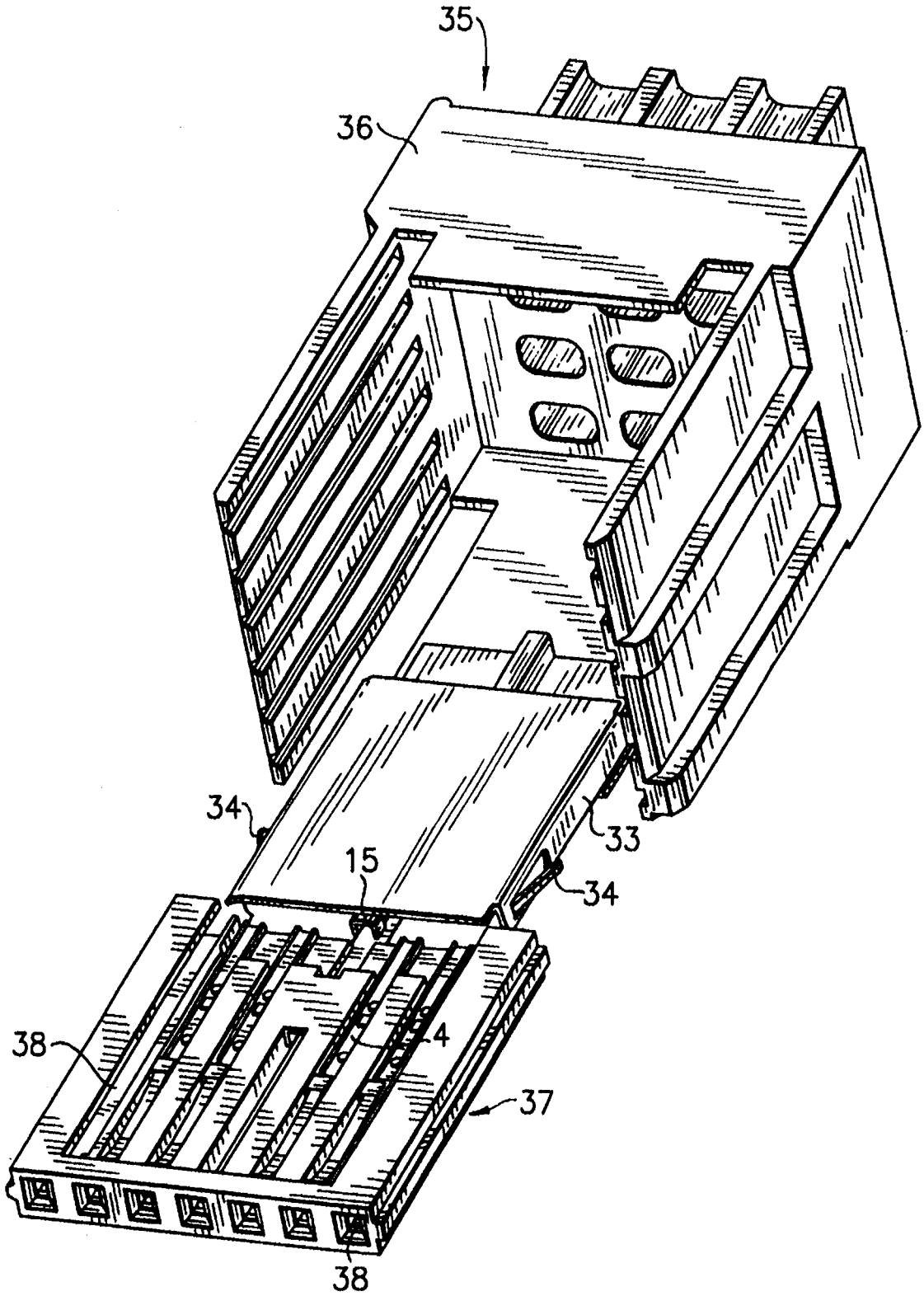
FIG. 10 shows a perspective view of a fourth embodiment of the connector of the invention in a disassembled manner.

If sufficient space is available on the printed circuit board seven contact pins aligned can be used and the end edges of the ground plates 20, 22 can be provided with a U-shaped edge part 6. As an alternative the perpendicular side edges 33 of the ground plate 14 can be made with a contact spring 34 as schematically shown in FIG. 10. FIG. 10 shows a connector 35 with a housing 36 wherein six connector modules 37 can be pushed into said housing, only one of which being shown in FIG. 10. Each connector module 37 has four cavities for receiving female signal contact members 4, wherein a cavity for the U-shaped central part 15 of the ground plate 14 is provided between the two pairs of female signal contact members 4. The contact springs 34 project into adjacent cavities 38 into which ground contact pins can be inserted.

The invention is not restricted to the above-described embodiments which can be varied in a number of ways within the scope of the claims.

What is claimed is:

1. Connector for a cable for high frequency signals, in particular for connecting cables with contact pins on a printed circuit board, comprising a ground plate, a housing of dielectric material with cavities for receiving female contact members, at least one female signal contact member and at least one female ground contact member formed out of the ground plate unitary with the ground plate, wherein a plurality of housings with ground plate and female contact members are mounted in a second housing of insulating material, each ground plate comprising at both sides a lateral extension with an edge part substantially perpendicular to the main surface of the ground plate, said edge part being located on an outer wall of the second housing and adapted to cooperate with a contact spring of a shielding plate of a connector with male contact pins.

2. Connector according to claim 1, wherein each edge part comprises an obliquely bent end edge received in a slot of the second housing.

3. Connector according to claim 1, wherein a central part of the ground plate is bent into a U-shaped part with opposite legs to form a female ground contact member unitary with the ground plate, wherein contact springs are formed in said opposite legs of the U-shaped part, said contact springs being adapted to engage a ground contact pin insertable into the U-shaped part.

4. Connector according to claim 1, wherein at least one end edge of the ground plate is bent into a U-shaped edge part with opposite legs to form a female ground contact member unitary with the ground plate, wherein contact springs are formed in said opposite legs of the U-shaped edge part, said contact springs being adapted to engage a ground contact pin insertable into the U-shaped edge part.

5. Connector according to claim 1, wherein the ground plate comprises a main surface and edge parts substantially perpendicular to the main surface of the ground plate, wherein a ground contact spring is formed out of each edge part, said ground contact spring projecting into an adjacent cavity of the housing and adapted to engage a ground contact pin insertable into said cavity.

6. Connector according to claim 1, wherein said ground plate encloses the corresponding housing.

7. Connector according to claim 1, comprising successive housings each having a ground plate and female contact members, wherein the ground plate of one housing is also a ground plate for a preceding housing.

* * * * *